US005638844A

United States Patent [19]

Szekeres

[11] Patent Number: 5,638,844

[45] Date of Patent: Jun. 17, 1997

[54] DEVICE FOR THE CLEANING OF VENTILATION DUCTS

[75] Inventor: Istvan Szekeres, Basel, Switzerland

[73] Assignee: IWS, AG, Basel, Switzerland

[21] Appl. No.: 405,826

[22] Filed: Mar. 17, 1995

[30] Foreign Application Priority Data

Mar. 17, 1994 [CH] Switzerland ..... 803/94/7

[51] Int. Cl.[6] ..... B08B 9/04

[52] U.S. Cl. ..... 134/167 C; 118/306; 118/DIG. 10; 239/722; 239/DIG. 13

[58] Field of Search ..... 134/167 C, 168 C; 118/306, DIG. 10; 239/227, 722, DIG. 13

[56] References Cited

U.S. PATENT DOCUMENTS

| | | | |
|---|---|---|---|
| 3,001,534 | 9/1961 | Grant, Jr. | 134/167 R |
| 3,159,895 | 12/1964 | Perovich | 118/306 X |
| 3,265,309 | 8/1966 | Hammelmann | 239/227 X |
| 3,525,112 | 8/1970 | Masters | 134/167 C X |
| 3,880,176 | 4/1975 | Horne | 134/167 C |
| 3,994,310 | 11/1976 | Brandon | 134/167 C |
| 4,073,302 | 2/1978 | Jones | 134/167 C |
| 4,178,875 | 12/1979 | Moschetti | 118/306 X |
| 4,677,997 | 7/1987 | Strauss | 134/167 C |
| 4,699,163 | 10/1987 | Bazuik | 134/167 C |
| 4,700,422 | 10/1987 | Russell | 134/168 C X |
| 4,981,524 | 1/1991 | Waite | 134/167 C X |
| 5,113,885 | 5/1992 | Ramsey | 134/167 C |
| 5,213,120 | 5/1993 | Dickson | 134/102.1 |

FOREIGN PATENT DOCUMENTS

| | | | |
|---|---|---|---|
| 241340 | 11/1962 | Australia | 118/306 |
| 1432996 | 6/1969 | Germany . | |
| 2502056 | 7/1975 | Germany | 134/167 C |
| 3412137 | 10/1985 | Germany . | |
| 3502916 | 7/1986 | Germany . | |
| 2200970 | 8/1988 | United Kingdom . | |
| 2098300 | 11/1992 | United Kingdom . | |
| WO823417 | 10/1982 | WIPO . | |

*Primary Examiner*—Philip R. Coe
*Attorney, Agent, or Firm*—Leydig, Voit & Mayer

[57] ABSTRACT

The device serves for eliminating deposits (52) in ventilation ducts (14) in the stationary or non-stationary operating mode. The cleaning medium is a fluid sprayed out under high pressure from a spray head (3). The spray head (3) is carried by a supply pipe (2), through which lead the drive shaft coming from a motor (1) and a fluid channel. In the non-stationary operating mode, the device is integrated into a slide (15) which is pulled through the ventilation duct (14). The slide (15) is introduced into the ventilation duct (14) through an inspection port sealable by means of an inspection cover. Ventilation ducts (14) extending horizontally, vertically and obliquely can be treated. In the stationary operating mode for cleaning an inlet or outlet, a bend or a branch and, for example, also a vapour extractor, the device is held without a slide (15) in a supporting cover which is inserted into the inspection port.

17 Claims, 3 Drawing Sheets

DEVICE FOR THE CLEANING OF VENTILATION DUCTS

BACKGROUND OF THE INVENTION

The invention relates to a device for eliminating deposits in ventilation ducts by the use of cleaning fluid sprayed at high pressure.

Ventilation systems consist, on the one hand, of assemblies, such as filters, heat exchangers, air heaters or air coolers, fans and regulating members, and, on the other hand, of a ventilation-duct network. The assemblies are generally accessible from outside, so that their cleaning presents relatively few problems. External ventilation gratings and the immediate outlets and inlets of ventilation ducts are also cleaned satisfactorily in the customary way.

The cyclically necessary complete cleaning of the frequently branched and wide-ranging ventilation-duct networks presents appreciably greater problems. Depending on the ambient conditions, mixtures of particles of dirt, of grease, of metal and of dust and of chemical particles, etc. are deposited in the ventilation ducts and in time form relatively thick deposited layers. Micro-organisms, viruses, bacteria, pollen, spores, skin scales, hairs, textile fibres, paper fluff, etc. can also be included in these. The deposited layers adhere, sometimes extremely tenaciously, to the inner walls, lead to petrifactions and successively narrow the ventilation-duct cross-section. The cross-sectional narrowing results in decreasing effectiveness of the ventilation system. The more dirt is lodged in the duets, the poorer the ratio between the energy consumption and the degree of efficiency of the system becomes. Combustible deposits constitute a considerable safety risk. The deposited layers can often ignite easily and, if combustion occurs, the fire can spread throughout the duct network in the entire building. The impurities also result in a high safety risk for the persons in the vicinity of the system by virtue of the propagation of pathogenic agents.

Depending on local circumstances, pipe brushes or other special brushes, by means of which the deposits can be scraped off from the inner walls of the ventilation ducts, have hitherto been employed for the cleaning of ventilation ducts. This working method is suitable only for fat-free non-greasy deposits. Furthermore, brushing off is particularly laborious in the case of larger duct cross-sections, where the brush contour no longer corresponds to the duct cross-section, but the brush is much smaller. Moreover, fine cleaning is not achieved merely by brushing; the cleaning of longer horizontal segments, bends and branches also presents some difficulties.

Where oily or fatty deposits are concerned, flushing with hot water, to which specific solvents can be added, is carried out. Tenacious deposits are dissolved only inadequately in this way and, furthermore, a very high water consumption occurs. For cleaning at duct inlets and outlets, particularly on vapour extraction hoods and fat filters, water-cleaning guns working at high pressure are also employed, but their range is limited.

The cleaning methods and devices known thus far can therefore all not be considered as the best possible. There would have to be mentioned as disadvantages, these occurring alternately or in combination: the cleaning work has to be carried out essentially manually, a high energy and water consumption, insufficient degree of cleaning, particularly at locations in the duct network to which access is difficult from outside, an expenditure of work time which incurs high costs.

SUMMARY OF THE INVENTION

The object of the invention is, therefore, to provide a device which works largely automatically and is easy to operate and which allows a thorough and continuous cleaning of deposits of any type. The device is to be capable of being used in ventilation ducts extending horizontally, vertically and obliquely, over wide-ranging duct segments, with a low consumption of flushing agent and energy. Moreover, the device must also allow perfect cleaning even in problem zones—corners, branches, bends. To deal with the rough operating conditions, a precondition for the device is a robust construction. Of course, the device should not result in damage to the duct network and must meet all safety requirements.

BRIEF DESCRIPTION OF THE DRAWINGS

The invention is described in more detail below with reference to the accompanying drawings. In these.

DESCRIPTION OF THE PREFERRED EMBODIMENTS

Figure 1A:
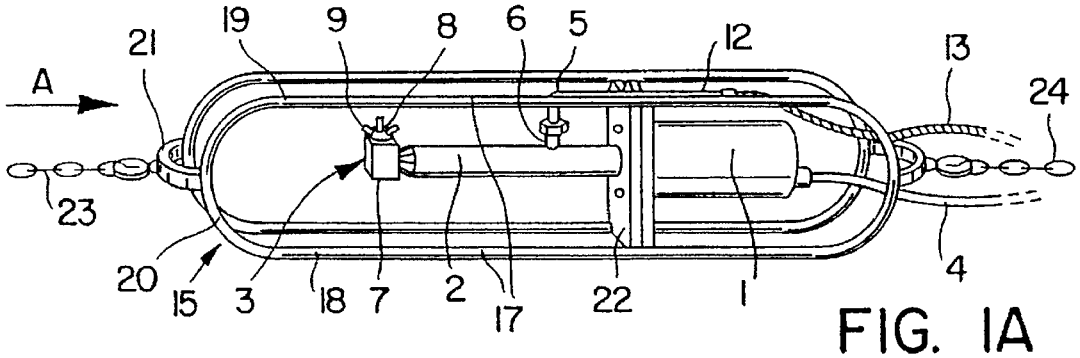
FIG. 1*a* shows a perspective view of the cleaning device in the slide with rounded lateral spars.
Figure 1B:
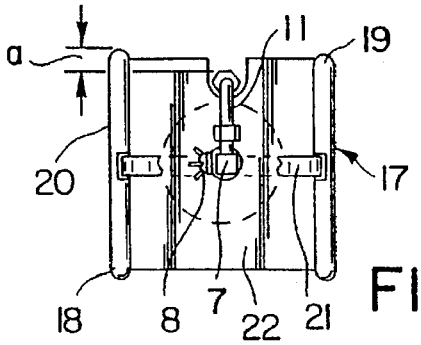
FIG. 1*b* shows a view according to the directional arrow A in FIG. 1*a;*

According to FIG. 1*a*, 1*b*; 2*a*, 2*b*; 3*a* and 4*a*, the device includes a motor 1, a supply pipe 2, and a spray head 3. A flexible feed conduit 4 projects into the motor 1 at the rear, as an electrical lead or as a pneumatic supply conduit, depending on whether the motor 1 is an electric motor or a pneumatic motor. Normally, an electric motor will be used on account of the universal availability of electrical energy. However, as regards cleaning work in a potentially explosive environment, pneumatics will be used for safety reasons.

The supply pipe 2 is attached centrally to the front side of the motor 1. Located in the supply pipe 2 is the extended drive shaft coming from the motor 1 and leading to the spray head 3. A service conduit 5 for supplying the cleaning fluid to the spray head 3 projects into the supply pipe 2. A fluid channel from the inlet 6 of the service conduit 5 to the spray head 3 is thus located in the supply pipe 2 next to the drive shaft. The spray head 3 includes a basic part 7 and an attachment part 8, the latter carrying one or more spray nozzles 9, from which the cleaning jets 10 are sprayed out in the operating state.

Via the drive shaft (not shown), the basic part 7 is set in rotation coaxially to the drive shaft about an axis of rotation. The attachment part 8 is also mounted rotatably, rotation taking place about a vertical axis. The rotational movement is transmitted to the attachment part 8 from the drive shaft by means of a transmission member. It is also possible to generate the rotational movement for the attachment part 8 from the recoil force of the cleaning jets 10 in the case of a corresponding spray-nozzle arrangement.

The service conduit 5—a rigid pipe segment—commences with a short connection piece 11 meeting the supply pipe 2 approximately vertically and then, without transition after a 90°-bend, continues rearwards as a horizontal piece 12. Connected to the horizontal piece 12 is a hose 13, via which the cleaning fluid is fed in. Depending on the particular instance of use, cold or hot water with or without additives or other solvents come under consideration as a cleaning fluid. The pressure at which the cleaning fluid is to emerge from the spray nozzles 9 can likewise be selected according to the pending cleaning task. As a rule, work is carried out in the range of 100 bar to 200 bar.

The device can be used for section cleaning on the one hand and for local cleaning on the other hand. Where section cleaning is concerned, the task is to clean a long ventilation-duct segment 14 (see FIGS. 3*a* and 3*b*) which extends, for example, over a distance of 20 m. In contrast, in the case of local cleaning, a duct bend, a branch, an inlet or outlet, that is to say, for example, also a vapour extractor in a large kitchen, is to be cleaned. If the device is used for local cleaning, it is fixed stationarily (see FIG. 4*a*), whilst, for section cleaning, the device is moved through the ventilation-duct segment 14 to be cleaned. In the case of ventilation-duct segments 14 extending approximately horizontally, the device is guided into and out of the ventilation-duct segment 14 to be cleaned and moved through it, that is to say practically pulled through it. Where ventilation-duct segments 14 extending approximately vertically are concerned, the device is expediently lowered from the top downwards.

For section cleaning, the device is surrounded by a slide 15. This slide 15 has the function of receiving and holding the device in it, so that the device can be brought through the ventilation-duct segment 14 in a specific position, without continuously hocking against the inner wall 16 of the ventilation-duct segment 14 and thereby causing damage to the device, to the inner wall 16 or to the feed or service conduit 4, 5. In particular, a pronounced oscillation and rotation of the device in the ventilation-duct segment 14 as a result of the recoil forces generated by the cleaning jets 10 is also prevented by means of the slide 15.

According to a first embodiment shown in FIGS. 1*a* and 1*b*, the slide 15 includes two vertically standing lateral spars 17 which are spaced parallel to one another and which are interconnected. A lateral spar 17 consists, in turn, of a lower longitudinal member 18 and of an upper longitudinal member 19 which extend parallel to one another and which are interconnected at the two ends via arc segments 20. The lower longitudinal member 18 has the function of a runner. The longitudinal members 18 and 19 thus extend along the device on four sides. The two lateral spars 18 are rigidly connected to one another at their ends by means of transverse shackles 21. Located between the motor 1 and the supply pipe 2 is an approximately square holding plate 22 which is attached and fixedly connected, for example by welding, to all four longitudinal members 18, 19, at one corner in each case. The device is thereby held approximately centrally in the slide 15, the upper longitudinal members 19 being located higher by the distance dimension a than the parallel extending horizontal piece 12 of the service conduit 5. The areas spanned between a lower and an upper longitudinal members 18, 19 or between the two lower longitudinal members 18 and between the two upper struts 19 are spaced from the device. It is therefore impossible for the device itself and the service conduit 5 to come into direct contact with an inner wall 16. A pull chain 23 or a holding chain 24 can engage on the transverse shackles 21 on one side or on both sides. Instead of the chains, cords of corresponding strength can also be used. Which function the chain has on the respective side depends on the direction of movement. One chain 23, 24 will have the main function, whilst the other chain would have to be attached for safety reasons only.

Figure 2A:
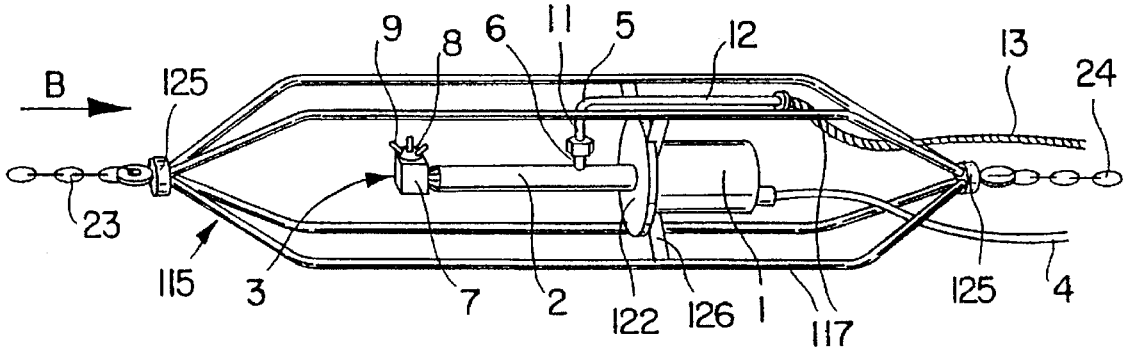
FIG. 2*a* shows a perspective view of the cleaning device in the slide with angled lateral spars.
Figure 2B:
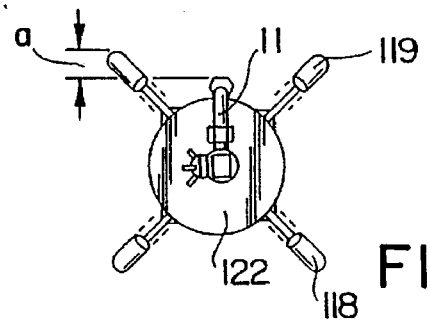
FIG. 2*b* shows a view according to the directional arrow B in FIG. 2*a;*

In the embodiment according to FIGS. 2*a* and 2*b*, the slide 115 and the holding plate 122 have a modified shape. Here, a lateral spar 117 likewise comprises, in each case, a lower strut 118 and an upper longitudinal member 119 extending parallel to one another. However, the longitudinal members 118, 119 are not connected to one another by means of arc segments, but they are angled at their ends and converge at an outer right-hand and left-hand junction point 125. The junction points 125 are located approximately on the horizontal mid-axis running longitudinally through the slide 115 and the device located in it. The ends of the longitudinal members 118, 119 are connected to one another, for example welded, at the junction points 125. A pull chain or holding chain 23, 24 is likewise attached respectively to the junction points 125.

Located between the motor 1 and the supply pipe 2 is a round holding plate 122, from which four holding webs 126 extend in a star-shaped manner to the longitudinal members 118, 119. The connections between the holding plate 122 and the four holding webs 126 as well as between these and the longitudinal members 118, 119 are rigid, for example made by means of welds. The two lower longitudinal members 118 once again assume the function of runners, insofar as the slide 115 is pulled approximately horizontally and, at the same time, is seated on the bottom of the ventilation-duct segment 14 to be cleaned. If the slide 115 is lowered or pulled up vertically, all the struts 118, 119 merely have the function of forming a holder and an open shield for the device.

Various modified versions are possible in addition to the embodiments illustrated. Thus, it will be possible to make do with three longitudinal members or more than four longitudinal members could be provided. It would be conceivable to attach rollers or projecting gliders to the longitudinal members. Furthermore, the longitudinal members can also be bent and connected to one another in a different way. It is desirable that a very open shield around the device be obtained. As shown in FIG. 1*b*, for example, the open shield surrounds the spray head 3 in a transverse plane extending perpendicular to the lengthwise direction of the slide 15, i.e., the spray head 3 is surrounded by an imaginary polygon formed by imaginary lines in this plane interconnecting all the longitudinal members 18, 19 of the slide 15. For fastening the device in the slide, many other possibilities are available to the average person skilled in the art. Thus, the holding webs could extend directly from the motor housing, or the supply pipe too can be fixed securely. It is desirable that the device be held stably in the slide.

Figure 3A:
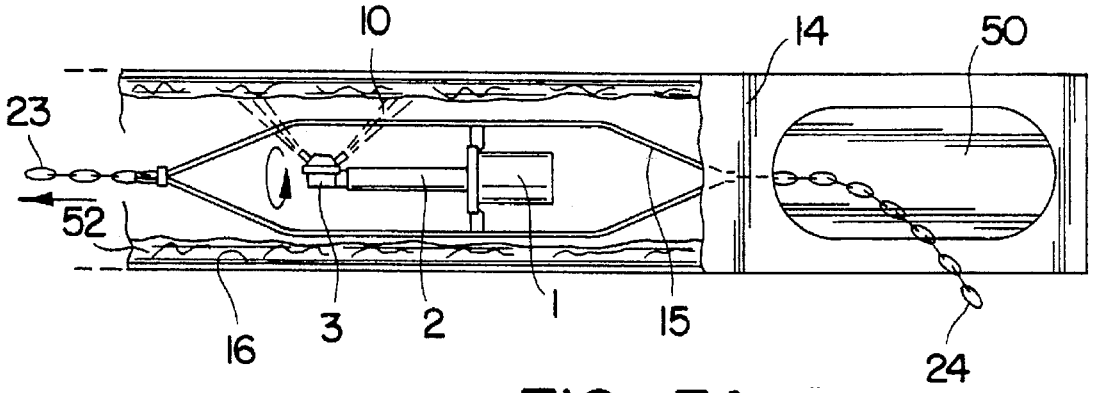
FIG. 3*a* shows a basic representation of the cleaning device according to FIG. 2*a* in a ventilation-duct segment with an inspection port.
Figure 3B:
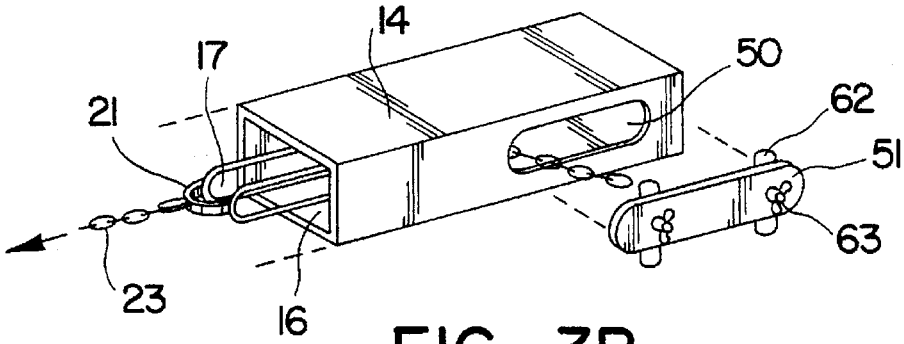
FIG. 3*b* shows a ventilation-duct segment with an inspection port and sealing cover.
Figure 4A:
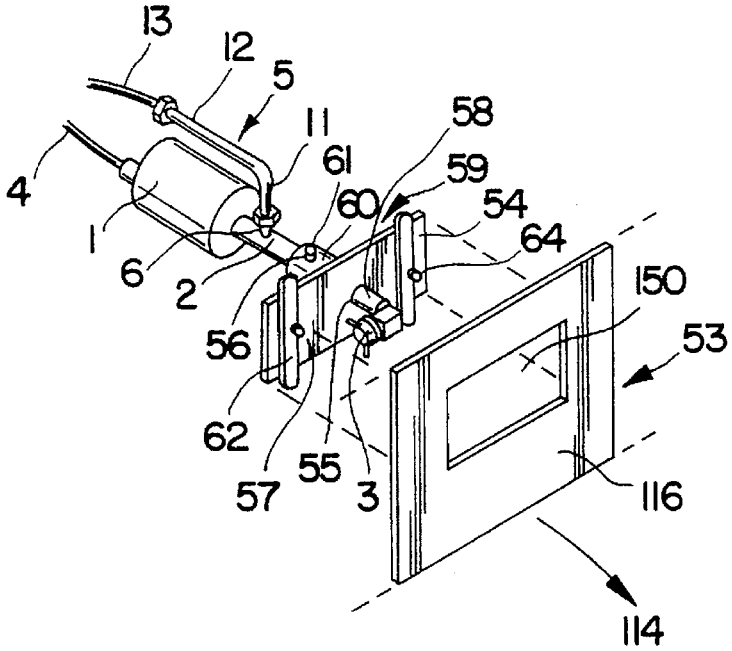
FIG. 4*a* shows a perspective view of the cleaning device in a flat supporting cover.

The description of the device with slide 115, when used for section cleaning, now follows with reference to FIGS. 3*a* and 3*b*. First of all, the complete structure is introduced into the ventilation-duct segment 14 to be cleaned. However, the pull chain 23 will be pulled in beforehand, if an approximately horizontal ventilation-duct segment 14 is concerned. The structure is introduced via an existing inlet or a fabricated inspection port 50 which can be sealed by means of a removable inspection cover 51. When the structure—the device together with the slide 115—is in the ventilation-duct segment 14 and the pull chain 23 runs inside the ventilation-duct segment 14 and projects out of an outlet port (not shown), then the device can be activated. The feed conduit 4 for driving the motor 1 and the hose 13 for serving the spray head 3 also follow (not shown) through the inspection port 50. The lower struts 118 acting as runners sit on the inner wall 16, that is to say on the bottom of the ventilation-duct segment 14. The layer of dirt 52 to be removed is located on the inner walls 16.

In a ventilation-duct segment 14 extending approximately horizontally, the slide 115 together with the device which is in operation is pulled via the pull chain 23 through the ventilation-duct segment 14 to be cleaned. At least an outlet port is required for the pull chain 23. If the outlet port is sufficient, the entire structure could be taken out of the ventilation-duct segment 14 there, the feed conduit 4 and the service conduit 5 released after switch-off and the conduits 4, 5 previously following through the inspection port 50 during the advance pulled out again. As a rule, however, the entire structure will be pulled back by means of the holding chain 24 and the conduits 4, 5 guided back. During the "return trip", the device can still be left in operation and cleaning thereby carried out a second time. During the movement of the device through the ventilation-duct segment 14, in the activated state the cleaning jets 10 spray out of the spray nozzles 9 and release the layer of dirt 52, the spray head 3 rotating about its two axes, so that the entire inner wall 16 is sprayed. The cleaning fluid laden with dirt flows off automatically or is discharged from the ventilation-duct segment 14 in a known way. The slide 15 located in a ventilation-duct segment 14, together with the device according to FIGS. 1*a* and 1*b*, is shown once again in FIG. 3*b*.

In a vertical or highly inclined ventilation-duct segment 14, the structure comprising the slide 15, 115 and of the device is lowered and, in practice, also pulled up again on the holding chain 24. Where special configurations are concerned, the structure could also be introduced with the motor side first. In that case, either the feed conduit 4 and the service conduit 5 would follow in the bend or the supply would be provided beforehand virtually in reverse from the outlet port.

If the device is used for local cleaning (see FIG. 4*a*), the slide 15, 115 is not required. In such an instance of use, the ventilation duct 114 to be cleaned is delimited relative to the outside by an outer wall 53. An inspection port 150, which is sealed by means of an inspection cover (not shown), is preferably provided in the outer wall 53. If the device is to be attached, a supporting cover 54 is employed. The supporting cover 54 has two special features in comparison with the inspection cover. Located in the supporting cover 54 is a passage bore 55, through which a supporting pipe 56 for receiving the supply pipe 2 of the device projects, at most a short supporting-pipe segment 58 being present on the inside 57 of the supporting cover 54, whilst a longer supporting-pipe segment 60 is attached on the outside 59. One or more clamping screws 61 are located on the longer outer supporting-pipe segment 60.

The assembly sequence is as follows. The spray head 3 is detached from the supply pipe 2, whereupon the supply pipe 2 is inserted through the supporting pipe 56, so that the supply pipe 2 projects sufficiently out of the short inner supporting-pipe segment 58. The clamping screws 61 are tightened in order to fix the supply pipe 2 in the supporting pipe 56. The spray head 3 is subsequently reattached. The inspection cover is then removed from the inspection port 150 and the supporting cover 54 is inserted into the inspection port 150. The supporting cover 54 is fixed in the inspection port 150 as a result of the rotation of the locking element 62 located on the inside 57, the locking element 62 being braced against the inner wall 116 of the outer wall 53 by means of tension screws (not shown) located on the outside 59. Where the bracing is concerned, there is identity to the inspection cover 51 shown in FIG. 3*b*, with the locking elements 62 and the tension screws 63.

When the preparations are made thus far—the device is held securely and the spray head 3 projects into the ventilation duct 114 to be cleaned—, the device can be put into operation. As a result of the intensive impact of the cleaning jets, the space to be cleaned, together with fittings possibly located therein, is freed of the layer of dirt deposited there. After the conclusion of the spraying operation, the supporting cover 54 together with the device is removed, and, after the conclusion of the remaining work, the inspection port 150 is sealed again by means of the inspection cover.

Figure 4B:
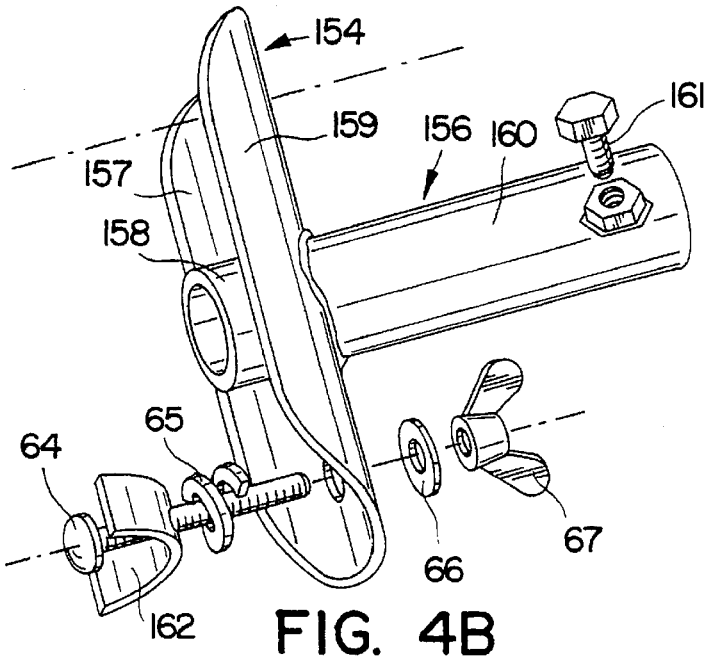
FIG. 4*b* shows a perspective view of a curved supporting cover.
Figure 4C:
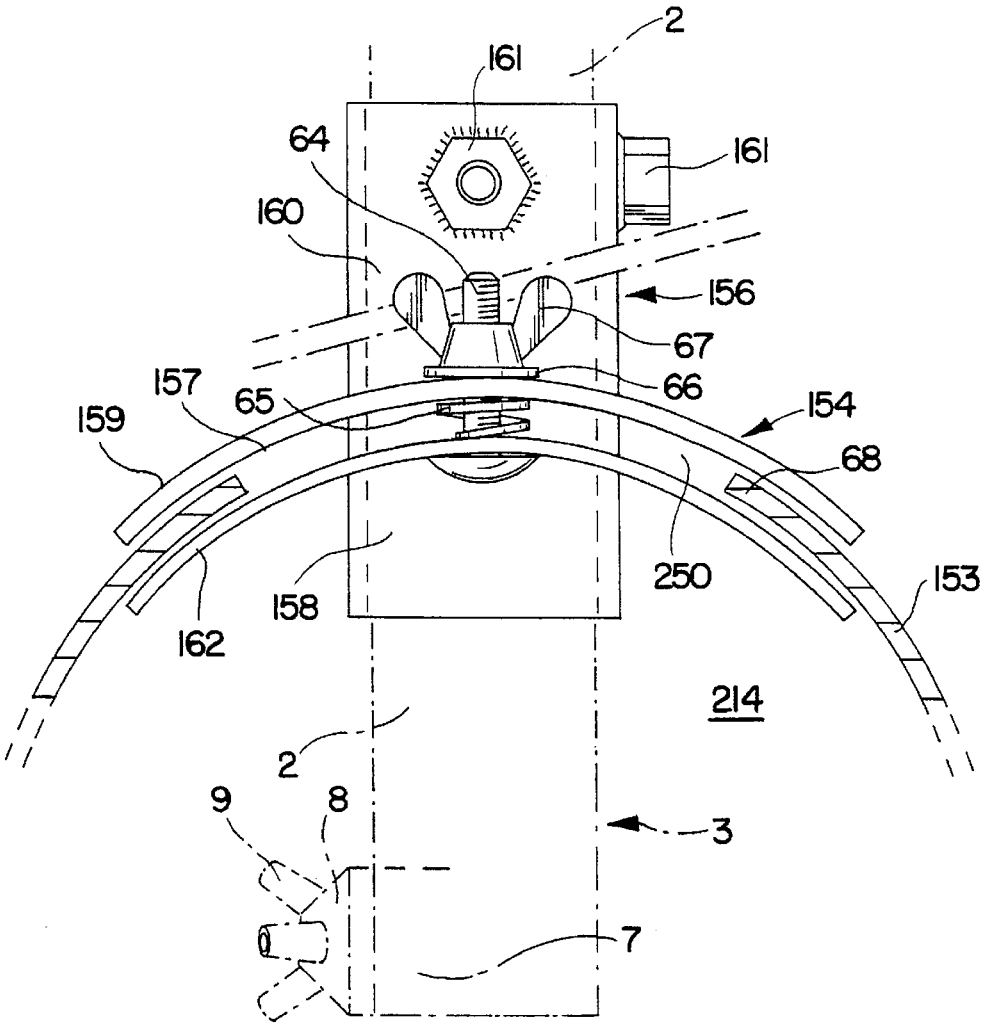
FIG. 4*c* shows a sectional view with the supporting cover according to FIG. 4*b* at an inspection port.

FIGS. 4*b* and 4*c* show a variation of the supporting cover 154 which was designed for round ventilation ducts 214. This supporting cover 154 is curved according to the rounding of the ventilation-duct segment 214 to be cleaned. The supporting pipe 156 projects through the supporting cover 154, once again only a short supporting-pipe segment 158 projecting on the inside 157, whilst a longer supporting-pipe segment 160 is attached to the outside 159 of the supporting cover 154. Here too, at least one clamping screw 161 is provided at the outer end of the longer supporting-pipe segment 160, in order to fix the supply pipe 2 of the device. The locking elements 162 (provided in duplicate) are also curved correspondingly and, in their span, project somewhat beyond the supporting cover 154. There extends for bracing through the locking elements 162 and supporting cover 154 a bolt 64, on which a spring element 65 is located between the locking element 162 and the supporting cover 154. A washer 66 is slipped onto the bolt 64 and a wing nut 67 screwed on from the outside 159.

FIG. 4*c* reveals how the supporting cover 154 and the locking elements 162 surround the edge zones 68 of a duct wall 153 having an inspection port 250 in a tubular ventilation duct 214 and how the supporting cover 154 is thereby fixed in the inspection port 250, the front end of the supply pipe 2 and the spray head 3 seated thereon projecting out from the short supporting-pipe segment 158 pointing inwards.

What is claimed is:

1. A cleaning device for ventilation ducts comprising:

a slide having at least three longitudinal members extending in a lengthwise direction of the slide and a holding plate extending transversely to the lengthwise direction of the slide and secured to each of the longitudinal members;

a spray head for spraying a cleaning liquid mounted on the slide, the longitudinal members defining an open shield surrounding the spray head in a first plane perpendicular to the lengthwise direction of the slide; and a motor supported by the holding plate and drivingly connected to the spray head to rotate the spray head about a first axis extending in the lengthwise direction of the slide.

2. A cleaning device as claimed in claim 1 wherein the spray head is approximately centered with respect to the longitudinal members in the first plane perpendicular to the lengthwise direction of the slide.

3. A cleaning device as claimed in claim 1 wherein the holding plate is rectangular and the slide includes four of the longitudinal members, each secured to a corner of the holding plate.

4. A cleaning device as claimed in claim 1 including a supply pipe extending between the motor and the spray head, the motor being drivingly connected to the spray head through the supply pipe, and a service conduit for cleaning fluid opening onto an interior of the supply pipe between the motor and the spray head and fluidly communicating with the spray head through the interior of the supply pipe.

5. A cleaning device as claimed in claim 1 including a service pipe supported by the slide and fluidly communicating with the spray head and surrounded in a second plane perpendicular to the lengthwise direction of the slide by the open shield defined by the longitudinal members.

6. A cleaning device as claimed in claim 1 wherein the longitudinal members are parallel to one another in a region surrounding the spray head.

7. A cleaning device as claimed in claim 1 including a pulling member for pulling the cleaning device through a duct connected to each lengthwise end of the slide along a lengthwise axis centered with respect to the longitudinal members.

8. A cleaning device for ventilation ducts comprising:

a slide having at least three longitudinal members extending in a lengthwise direction of the slide;

a spray head for spraying a cleaning liquid mounted on the slide, the longitudinal members defining an open shield surrounding the spray head in a first plane perpendicular to the lengthwise direction of the slide; and a motor supported by the slide and drivingly connected to the spray head to rotate the spray head about a first axis extending in the lengthwise direction of the slide, the spray head including a first portion drivingly connected to the motor for rotation about the first axis and a second portion mounted on the first portion for rotation about a second axis extending transversely with respect to the first axis, the second portion of the spray head including a spray nozzle for discharge of cleaning fluid.

9. A cleaning device as claimed in claim 8 wherein the second axis is perpendicular to the first axis.

10. A cleaning device for ventilation ducts comprising:

a slide comprising first and second lateral spars disposed on opposite widthwise sides of the slide, each lateral spar comprising two longitudinal members extending in parallel in a lengthwise direction of the slide and a connecting member extending between a first lengthwise end of and coplanar with the two longitudinal members of the lateral spar; and a spray head for spraying a cleaning liquid mounted on the slide, the longitudinal members defining an open shield surrounding the spray head in a first plane perpendicular to the lengthwise direction of the slide.

11. A cleaning device as claimed in claim 10 including a motor supported by the slide and drivingly connected to the spray head to rotate the spray head about a first axis extending in the lengthwise direction of the slide.

12. A cleaning device as claimed in claim 10 wherein the connecting member extends in an arc between the first lengthwise end of the two longitudinal members of the lateral spar.

13. A cleaning device as claimed in claim 10 including a transverse member to which a pulling member for pulling the cleaning device through a duct can be attached extending between the connecting members of the two lateral spars.

14. A cleaning device as claimed in claim 13 wherein the transverse member comprises a shackle.

15. A cleaning device for ventilation ducts comprising:

a slide having first and second lateral spars disposed on opposite widthwise sides of the slide parallel to each other, each lateral spar comprising two longitudinal members extending in a lengthwise direction of the slide and a first arcuate connecting member coplanar with the longitudinal members and extending between a first lengthwise end of the first and second longitudinal members; and a spray head for spraying a cleaning liquid mounted on the slide.

16. A cleaning device as claimed in claim 15 wherein the slide includes a shackle extending transversely between the first connecting members of the lateral spars.

17. A cleaning device as claimed in claim 15 wherein each lateral spar includes a second arcuate connecting member coplanar with the first and second longitudinal members of the lateral spar and extending between a second lengthwise end of the first and second longitudinal members of the spar.

* * * * *